US008990984B2

(12) United States Patent
Hochman et al.

(10) Patent No.: US 8,990,984 B2
(45) Date of Patent: Mar. 31, 2015

(54) MEDICAL BED

(71) Applicants: Leon Hochman, West Bloomfield, MI (US); Nancy Valvona, West Bloomfield, MI (US); Stephen Nicolato, West Bloomfield, MI (US)

(72) Inventors: Leon Hochman, West Bloomfield, MI (US); Nancy Valvona, West Bloomfield, MI (US); Stephen Nicolato, West Bloomfield, MI (US)

( * ) Notice: Subject to any disclaimer, the term of this patent is extended or adjusted under 35 U.S.C. 154(b) by 0 days.

(21) Appl. No.: 14/154,795

(22) Filed: Jan. 14, 2014

(65) Prior Publication Data

US 2014/0304919 A1 Oct. 16, 2014

Related U.S. Application Data

(63) Continuation of application No. 13/721,570, filed on Dec. 20, 2012, now Pat. No. 8,640,286.

(51) Int. Cl.

| | |
|---|---|
| ***A61G 13/00*** | (2006.01) |
| ***A61G 7/002*** | (2006.01) |
| ***A61G 7/05*** | (2006.01) |
| ***A61G 13/08*** | (2006.01) |
| *A61G 13/12* | (2006.01) |

(52) U.S. Cl.

CPC ..... *A61G 7/002* (2013.01); *A61G 7/0506* (2013.01); *A61G 13/0009* (2013.01); *A61G 13/08* (2013.01); *A61G 13/1245* (2013.01); *A61G 13/125* (2013.01); *A61G 13/129* (2013.01); *A61G 2200/327* (2013.01)

USPC ..... 5/619; 5/617

(58) Field of Classification Search

USPC ..... 5/617–619, 602, 600

See application file for complete search history.

(56) References Cited

U.S. PATENT DOCUMENTS

| | | | | |
|---|---|---|---|---|
| 1,553,901 | A * | 9/1925 | Hynes | 378/209 |
| 3,318,596 | A | 5/1967 | Herzog | |
| 3,599,963 | A * | 8/1971 | Grover | 5/618 |
| 4,085,471 | A | 4/1978 | Dimatteo et al. | |
| 5,582,379 | A | 12/1996 | Keselman et al. | |
| 5,737,786 | A | 4/1998 | Yamamoto | |
| 6,276,012 | B2 * | 8/2001 | Borders | 5/622 |
| 6,704,959 | B2 | 3/2004 | Schuerch | |
| 7,243,654 | B2 | 7/2007 | Schuerch | |
| 7,464,421 | B2 | 12/2008 | Goodwin et al. | |
| 7,536,734 | B2 | 5/2009 | Heimbrock | |
| 2008/0127421 | A1 | 6/2008 | Hornbach et al. | |

* cited by examiner

*Primary Examiner* — Fredrick Conley

(74) *Attorney, Agent, or Firm* — The Weintraub Group, P.L.C.

(57) ABSTRACT

A medical bed for positioning the patient in the lithotomy position having a mattress pad including a flexible footrest section. The footrest section cascades over and down an end of the medical bed as the mattress pad is translated, or slid, toward the end thereof. The mattress pad is positioned atop the frame, and includes a backrest section, a medial section, and a footrest section. The mattress pad is translatable, or slidable, with respect to the frame. The footrest section includes a plurality of partitioned segments that are pivotable with respect to each other such that the footrest section cascades down and over the foot-end of the frame when the mattress pad is translated toward the foot-end of the bed.

10 Claims, 9 Drawing Sheets

MEDICAL BED

BACKGROUND OF THE INVENTION

1. Field of the Invention

The present invention pertains to a medical bed for examining patients. More particularly, the present invention pertains to a medical bed for examining patients in the lithotomy position.

2. Description of the Prior Art

Medical beds for placing patients into the lithotomy position are well known in the art. The lithotomy position, as understood by one having ordinary skill in the art, is when the patient assumes the supine position (i.e., with the patient laying on his/her back) and the patient's hips and knees are flexed with the legs spread apart and raised and the feet resting in straps, or stirrups. This is also referred to as the dorsosacral position, and this position is commonly used during childbirth or gynecological exams.

Numerous medical beds for placing the patient in the lithotomy position have been used over time. Some of the earlier medical beds were not more than essentially a padded bed and a pair of leg stirrups.

Over time, backrests were developed that could be inclined and leg stirrups were also provided that could be adjusted both up-and-down and side-to-side, such as shown in U.S. Pat. No. 3,318,596 to Herzog.

Later designs were intended to allow the medical caregiver to get closer to the patient without having to reposition the patient. For example, U.S. Pat. No. 7,536,734 to Heimbrock discloses a lithotomy medical bed having a backrest section, a footrest section, and a medial section for supporting the patient's posterior. The bed also includes foot stirrups which can be adjusted up-and-down. The backrest section can be inclined from a horizontal position, and the medial section can also be inclined from a horizontal position to support the patient. As disclosed in Heimbrock, a typical lithotomy medical bed has a removable footrest section to provide access to the patient's pelvic area for caregivers like doctors and nurses. Removal of the footrest section also allows the stirrups to be positioned below the plane of the bed to allow the patient to sit upright. Another example of this type of medical bed is disclosed in U.S. Pat. No. 7,464,421 to Goodwin et al.

Thus, Heimbrock provides the caregiver with access to the patient's pelvic section by removing the foot section of the bed, and does not require the patient to be repositioned on the bed. However, there still remains room for improvement.

U.S. Patent Application Publication No. 2008/0127421 to Hornbach et al. discloses a lithotomy bed having an inclinable backrest section and a declinable footrest section. The backrest section, footrest section, and the section for supporting the patient's posterior are all slidable (or translatable), allowing the patient to be moved closer to the caregiver atop the frame of the bed. However, the footrest section must be moved forward toward the caregiver before it can be pivoted downward. Thus, the medical bed must first be positioned with the footrest section down before the caregiver can move into position near the patient's pelvic area.

Accordingly, there remains a need for a lithotomy medical bed which allows the caregiver to position him or herself at the footrest-end of the bed before, or while, the patient is translated toward the end of medical bed.

The present invention, as detailed hereinbelow, seeks to fill this need by providing a medical bed for positioning the patient in the lithotomy position having a mattress pad including a partitioned footrest section which cascades over and down the end of the medical bed as the mattress pad is translated toward the end thereof.

SUMMARY OF THE INVENTION

The present invention provides a medical bed for positioning the patient in the lithotomy position having a mattress pad including a flexible footrest section that cascades over and down an end of the medical bed as the mattress pad is translated toward the end of the medical bed.

Alternatively, the present invention provides a medical bed comprising: (a) a frame having a head-end and a foot-end; (b) a mattress pad positioned atop the frame, the mattress pad having a backrest section, a medial section, and a footrest section, the backrest section being oriented toward the head-end of the frame, and the footrest section being oriented toward the foot-end of the frame, the mattress pad being translatable with respect to the frame, the footrest section including a plurality of partitioned segments that are pivotable with respect to each other; and (c) wherein the footrest section cascades down and over the foot-end of the frame when the mattress pad is translated toward the foot-end of the bed.

In yet another description hereof, the present invention provides a medical bed comprising: (a) a frame having a head-end and a foot-end, the frame including at least one linear track having a substantially straight section and a curvilinear section, the curvilinear section being positioned at the foot-end of the frame and extending down and over the foot-end of the frame; (b) a carriage including a plurality of slats which are pivotally engaged with each other, the carriage further including a plurality of brackets, the brackets being connected to a respective slat and at least one wheel connected to the bracket, the wheels being engaged in the linear track, whereby the carriage is translatable with respect to the track; (c) a mattress pad positioned atop the frame, the mattress pad having a backrest section, a medial section, and a footrest section, the backrest section oriented toward the head-end of the frame, and the footrest section oriented toward the foot-end of the frame, the footrest section including a plurality of partitioned segments that are pivotable with respect to each other, wherein the footrest section cascades down and over the foot-end of the frame when the carriage and mattress pad are translated toward the foot-end of the frame.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

Figure 1:
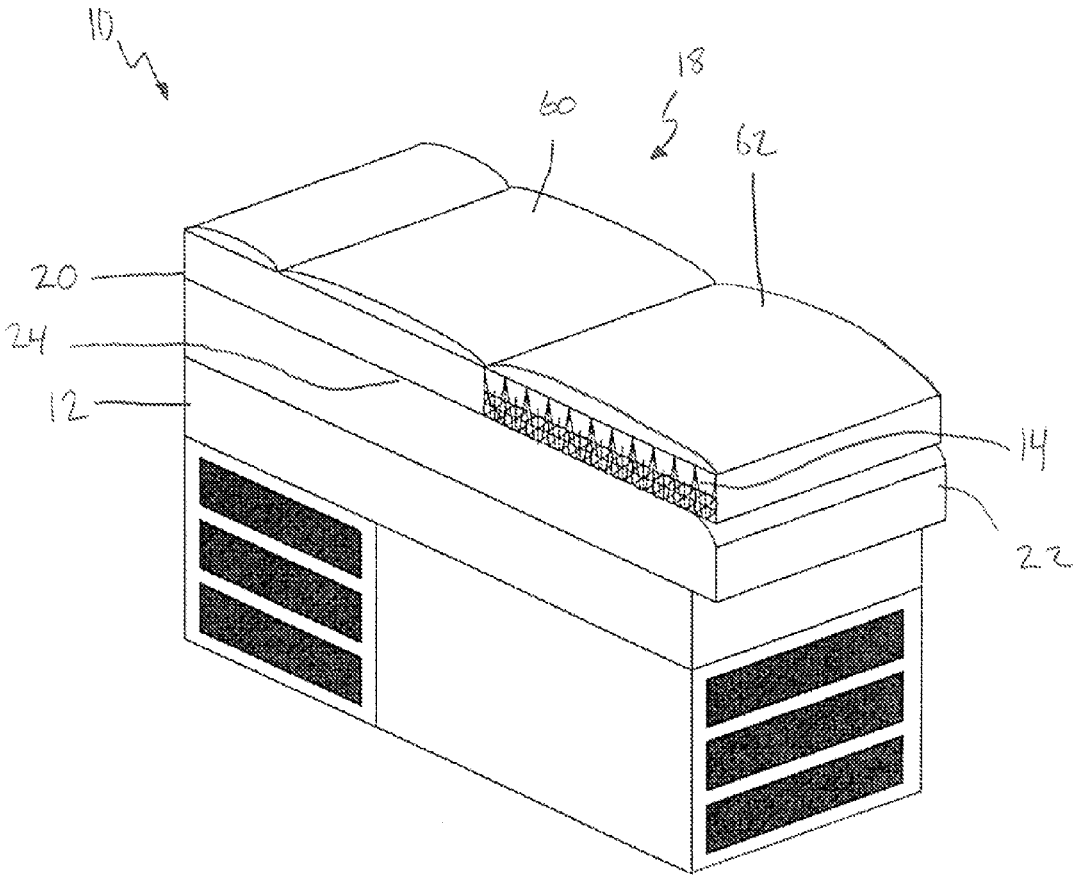
FIG. 1 is a perspective view of a first embodiment of the present invention hereof.
Figure 2:
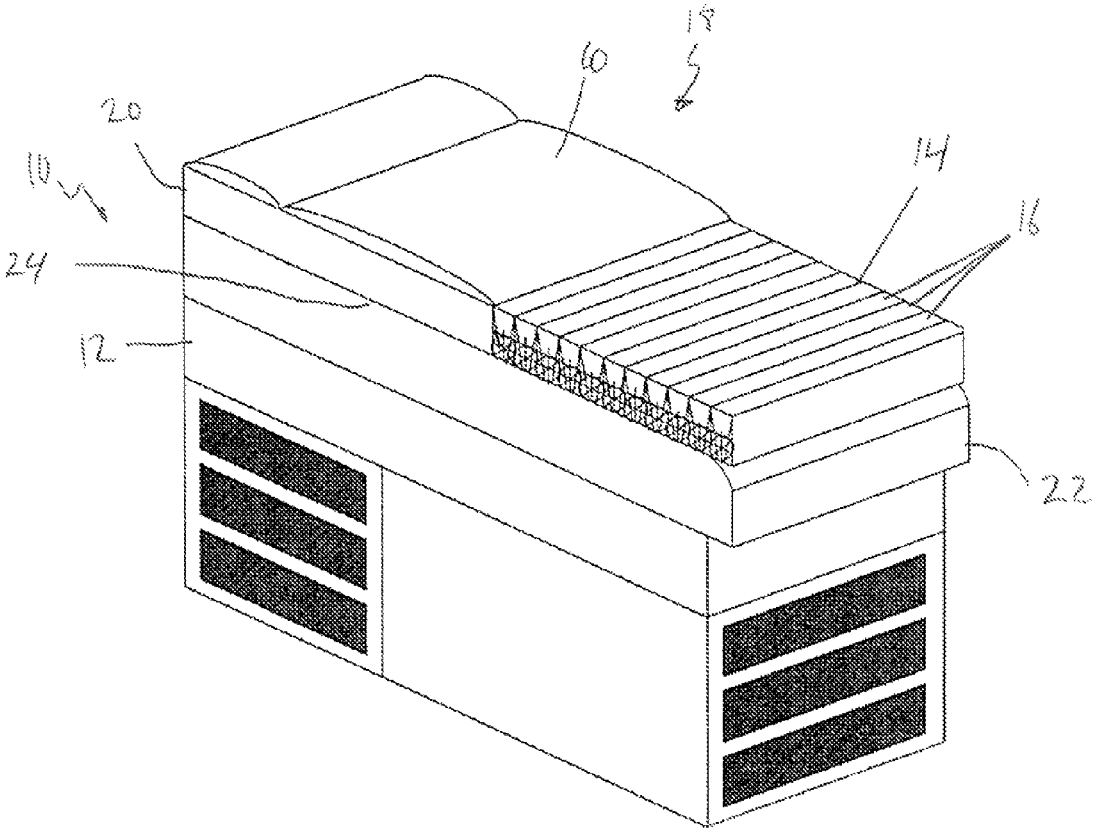
FIG. 2 is a perspective view of the medical bed with the footrest section of the mattress pad removed showing the carriage.

In accordance with the present invention and as shown generally in FIGS. 1 and 2, there is provided a medical bed 10 comprising a frame 12, a carriage 14 including a plurality of slats 16 that are pivotally engaged with each other, and a mattress pad 18 positioned atop the frame 12.

The frame 12 includes a support structure similar to any medical bed found in the prior art, particularly like those disclosed in U.S. Pat. No. 7,464,421 to Goodwin et al. or U.S. Pat. No. 3,318,596 to Herzog, the disclosures of which are hereby incorporated by reference. As discussed in further detail below, the frame 12 can include controls and actuators (or drive means) (not shown) for moving or adjusting particular parts of the carriage 14 and mattress pad 18. The frame 12 has a head-end 20 and a foot-end 22, which are appropriately named for the respective ends of the patient.

Figure 3:
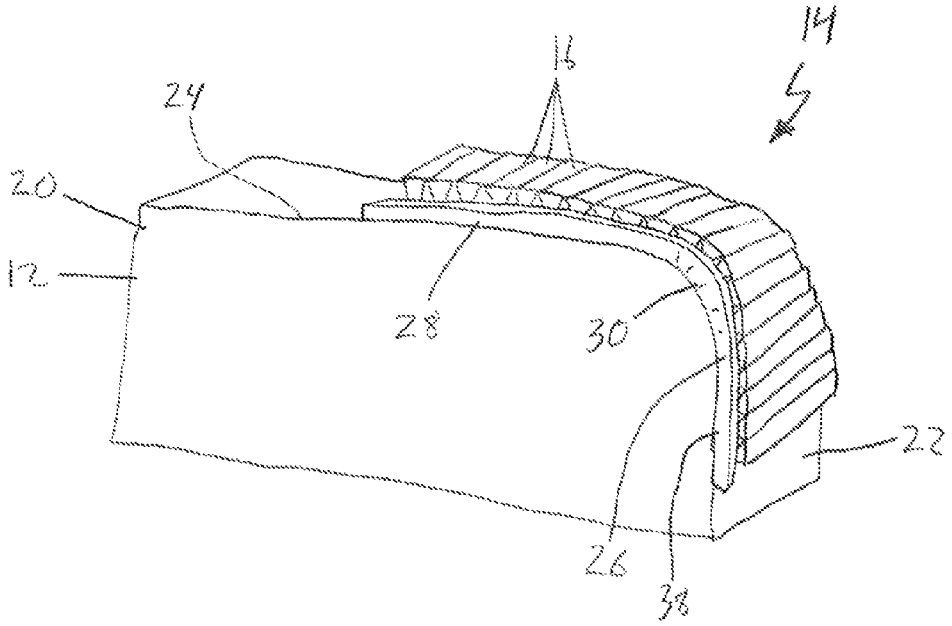
FIG. 3 is a perspective view showing the carriage and track atop the frame of the medical bed.
Figure 4:
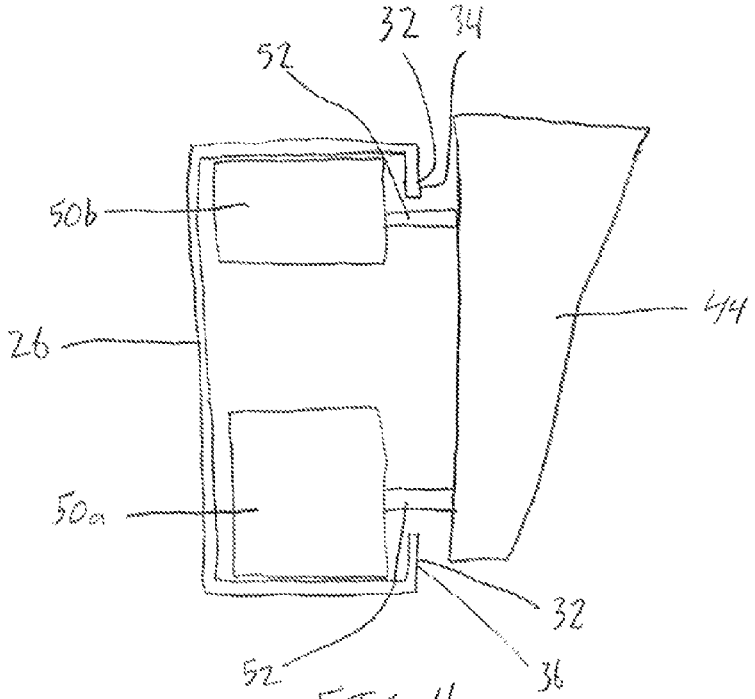
FIG. 4 is an enlarged view showing an enlarged cross-section view of a "C-shaped" track retaining a mounting bracket and wheels.
Figure 5:
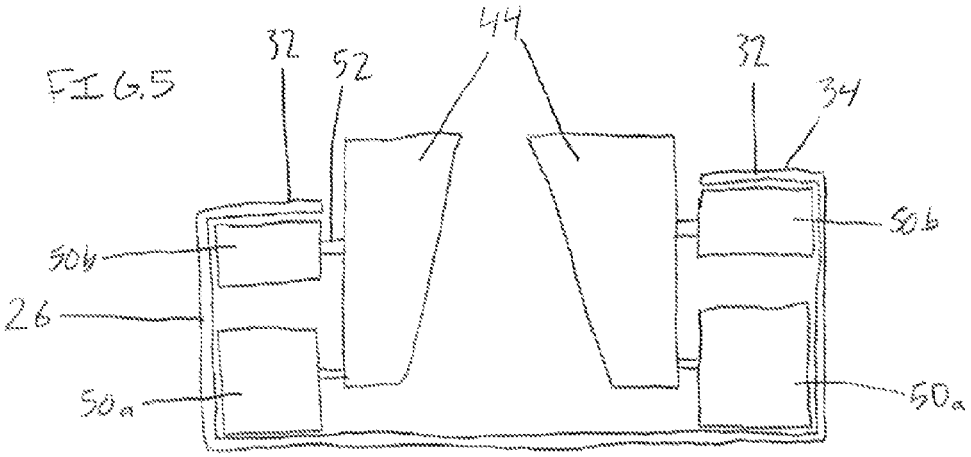
FIG. 5 is an enlarged view showing an enlarged cross-section view of a "U-shaped" track retaining a pair of opposed mounting brackets and wheels.

As shown in FIG. 3, the top section 24 of the frame 12 includes at least one continuous linear track 26 having a substantially straight section 28 and a curvilinear section 30 for supporting the carriage 14 and allowing the carriage 14 to slide atop the frame 12. The curvilinear section 30 of the track 26 is positioned at the foot-end 22 of the frame 12 and extends down and over the foot-end 22 of the frame 12. Any suitable type of track that can engage and retain a movable member is suitable for use herewith. For example, and as shown in FIGS. 4 and 5, the track 26 can have a cross-section that is U-shaped, C-shaped, or the like. Preferably, the track 26 has a cross-section that is a suitable rolling surface for a rolling member. The track 26 also preferably includes at least one retaining lip 32, or wall, to retain the rolling member therein. Optionally, the track 26 can include two retaining lips 32: one at a top edge 34 and one at a bottom edge 36 of the track 26. The frame 12 preferably includes at least two tracks 26: one for supporting each side of the carriage 14. Optionally, and for reasons discussed further below, the frame 12 can include four tracks 26: two for supporting each side of the carriage 14.

The first straight section 28 of the linear track 26 can be substantially horizontal atop the frame 12, and the curvilinear section 30 curves down and over the foot-end 22 of the frame 12. The curvilinear section 30 can curve downward approximately 90° from the straight horizontal section 28. Although not shown, it is contemplated herein that the curvilinear section 30 can curve, or bend, more or less than 90° with respect to the straight section 28. In other words, the curvilinear section 30 can optionally curve outwardly from the bed 10 or back toward, and into, the frame 12 of the bed 10. In this regard, it is contemplated that the curvilinear section 30 can even bend up to an entire 180° back into the bed 10 if so desired.

In an alternate embodiment not shown in the drawings, the track 26 is substantially straight along the entire length thereof, and does not include the curvilinear section 30. Rather than curving downward as described above, the track 26 extends horizontally and substantially straight off the end 22 of the bed 10, thereby allowing the patient to be translated toward the end 22 of the bed 10, such as when the patient is in the prone position (i.e. laying flat with the chest down and back upward).

Optionally, the track 26 can also include a second straight section 38 attached to the curvilinear section 30 opposite the first straight section 28, thereby placing the curvilinear section 30 between the two straight sections, 28 and 38, and allowing for a greater total length of the carriage 14 that can be passed over the curvilinear section 30.

Figure 6:
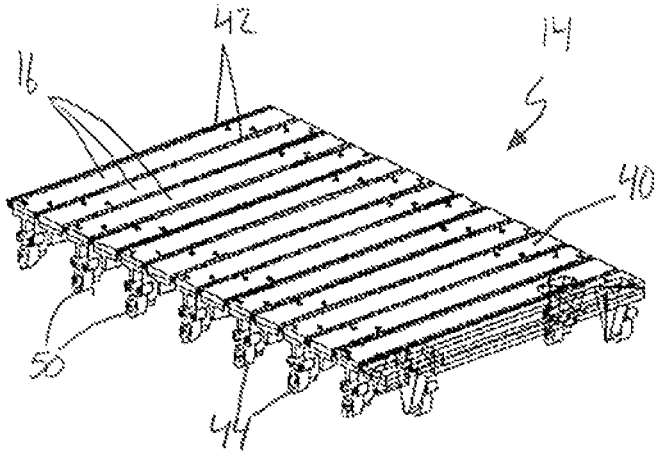
FIG. 6 is a perspective view of the carriage showing the slats and the mounting brackets attached thereto, and in particular, showing a carriage including four sets of mounting brackets in which the pair of mounting brackets on each side of the slats are offset from each other.
Figure 7:
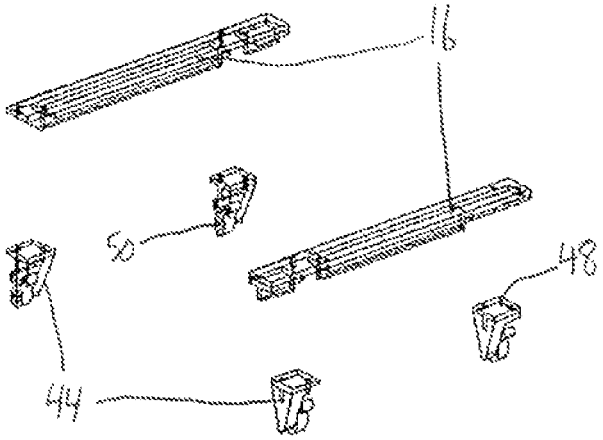
FIG. 7 is an exploded view of a pair of slats and four mounting brackets as oriented in the carriage shown in FIG. 6.

As shown throughout the drawings, and particularly in FIGS. 3, 6, and 7, a carriage 14 is provided which rides atop, and is retained by the track 26. The carriage 14 is slidable, or translatable, along the track 26. The carriage 14 includes a plurality of slats 16 extending from one lateral side of the medical bed 10 to the other. Each slat 16 is preferably elongated and has a rectangular planar upper surface 40 upon which the mattress pad 18 is attached, or positioned.

The slats 16 are pivotally engaged with each other along their adjacent lateral sides 42 allowing the carriage 14 to translate over the curvilinear section 30 of the track 26. The slats 16 are pivotally secured to each other using any suitable mechanism that is well-known in the art, including a hinge or the like.

A plurality of mounting brackets 44 are provided, any number of which can be attached to a bottom surface 46 of at least some of the slats 16. Each mounting bracket 44 has an upper surface 48 that is secured to the bottom surface 46 of the respective slat 16. Each mounting bracket 44 also includes at least one rotatable wheel 50 that is retained within the track 26. Each wheel 50 includes an axle 52 that permits the wheel 50 to rotate with respect to the mounting bracket 44. The wheel 50 is rollable within the track 26, thereby allowing the carriage 14 to slide along the track 26 as the wheels 50 rotate within the track 26. Preferably, each mounting bracket 44 includes three rotatable wheels 50: a lower wheel **50*a* for bearing the weight of the carriage 14, and two upper wheels 50*b* which assist with travel through the curvilinear section 30 of track 26 and which also cooperate with the lower wheel 50*a* and to retain the wheels 50 within the track 26. In some arrangements, the upper wheels 50*b* may also support the weight of the carriage 14, such as when the curvilinear section 30** bends more than 90°.

It is understood that in order for the carriage 14 to slide properly over the curvilinear section 30 of the track 26, the wheels 50 in the track 26 may not touch each other or they will bind together, allowing no further movement along the track 26. There are several geometric constraints that determine whether the wheels 50 will bind, for instance, the diameter of the wheels 50, the radius of curvature of the curvilinear section 30 of the track 26, and the width of the slats 16. In order to ensure adequate performance and comfort of the translating motion of the mattress pad 18, it may be desirable to provide four tracks 26: two tracks 26 for each lateral end of the slats 16. In this regard, mounting brackets 44 can be mounted to the bottom surface 46 of the slats 16 in a staggered offset manner as shown in FIG. 6. By alternating the orientation of the wheels 50 of the successive mounting brackets 44 into the respective alternating tracks 26 (not shown), the distance between the wheels 50 can be significantly increased. This results in a larger permissible wheel 50 diameter and narrower slats 16, both of which contribute to a more comfortable and smoother translation of the mattress pad 18 over the curvilinear section 30.

Figure 9:
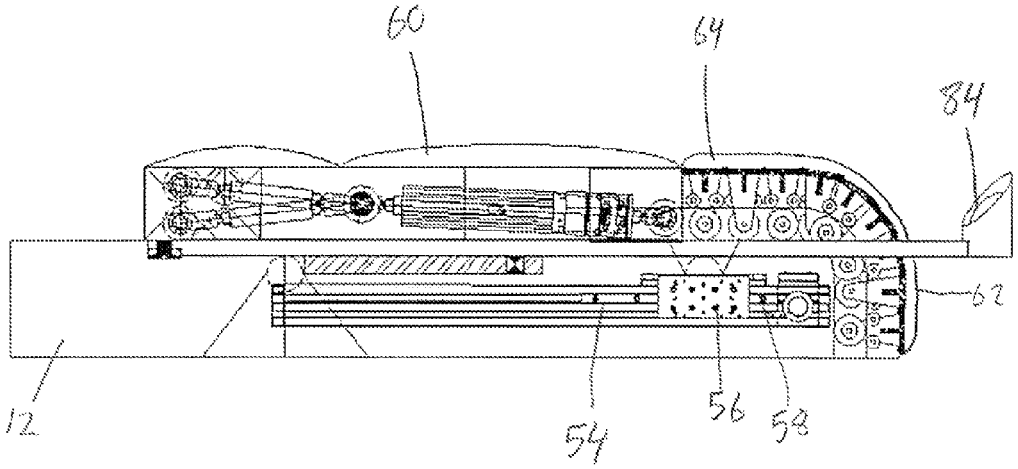
FIG. 9 is a side view of the top of the frame, mattress pad, and carriage, the frame, mattress pad, and carriage being shown partially transparent to display the linear actuators, the carriage and associated linear actuator being in an extended position.
Figure 8:
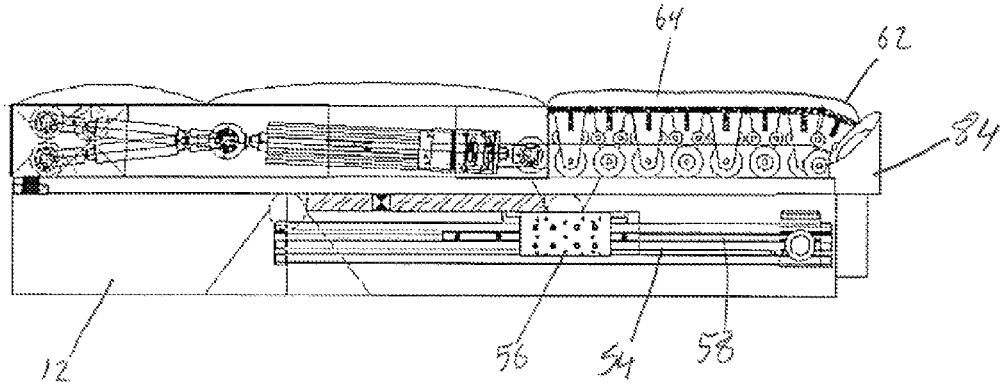
FIG. 8 is a side view of the top of the frame, mattress pad, and carriage, the frame, mattress pad, and carriage being shown partially transparent to display the linear actuators, the carriage and associated linear actuator being in a retracted position.

As shown in FIGS. 8 and 9, the carriage 14 can be translated along the track 26 using any suitable means which are well-known in the art. Preferably, a first linear actuator 54 is connected to and extends between the carriage 14 and the frame 12 of the bed 10. The first linear actuator 54 can be a mechanical actuator, a hydraulic actuator, a pneumatic actuator, or the like. If the linear actuator 54 is hydraulic or pneumatic, it is preferably a cylinder having a piston. If the linear actuator 54 is mechanical, it can comprise any suitable device which is well-known to deliver linear motion, including but not limited to, screw devices (e.g., a lead screw, a ballscrew, a screw jack, a roller screw), wheel-and-axle devices (e.g., rack and pinion, chain drive, belt drive), and cam actuators. Preferably, the linear actuator 54 is a leadscrew, which is known to include an internally-threaded nut (or block 56, shaft, etc.), and a rotating externally-threaded shaft. The threaded nut cannot rotate as a result of external forces, and as the threaded shaft rotates within the nut, the nut is driven up and down along the length of the shaft.

As shown in FIGS. 8 and 9, there is provided a block 56 having an internally-threaded bore, and the block 56 is secured to the carriage 14. There is also provided an externally-threaded drive shaft 58 that is threaded within the bore of the block 56. As the drive shaft 58 is rotated (such as by a motor), the block 56 is driven along the length of the drive shaft, thereby translating the carriage 14 and mattress pad 18 back-and-forth along the top section 24 of the medical bed 10.

There is also provided any suitable electrical control mechanisms or circuitry (not shown) to effectuate the caregiver's manual inputs to control the linear actuator 54 (as well any additional linear actuators described below). In this regard, the caregiver can easily and effortlessly slide the carriage 14 along the track 26 in either direction in order to position the patient as desired.

Also included is a mattress pad 18 positioned atop the frame 12 of the medical bed 10. The mattress pad 18 includes a backrest section 60, a medial section 64, and a footrest section 62. The backrest section 60 is oriented toward the head-end 20 of the frame 12, and the footrest section 62 is oriented toward the foot-end 22 of the frame 12. Preferably, the medial section 64 and the footrest section 62 are positioned atop the carriage 14. The backrest section 60, the medial section 64, and the footrest section 62 can all be pivotable with respect to each other. The backrest section 60, the medial section 64, and the footrest section 62 each comprise suitable materials and cushioning for supporting a patient and are of the type that is well-known in the art.

The footrest section 62 includes a plurality of partitioned segments 66 that are pivotable with respect to each other, wherein the footrest section 62 can cascade down and over the foot-end 22 of the frame 12 when the carriage 14 and mattress pad 18 are translated toward the foot-end 22.

Figure 10:
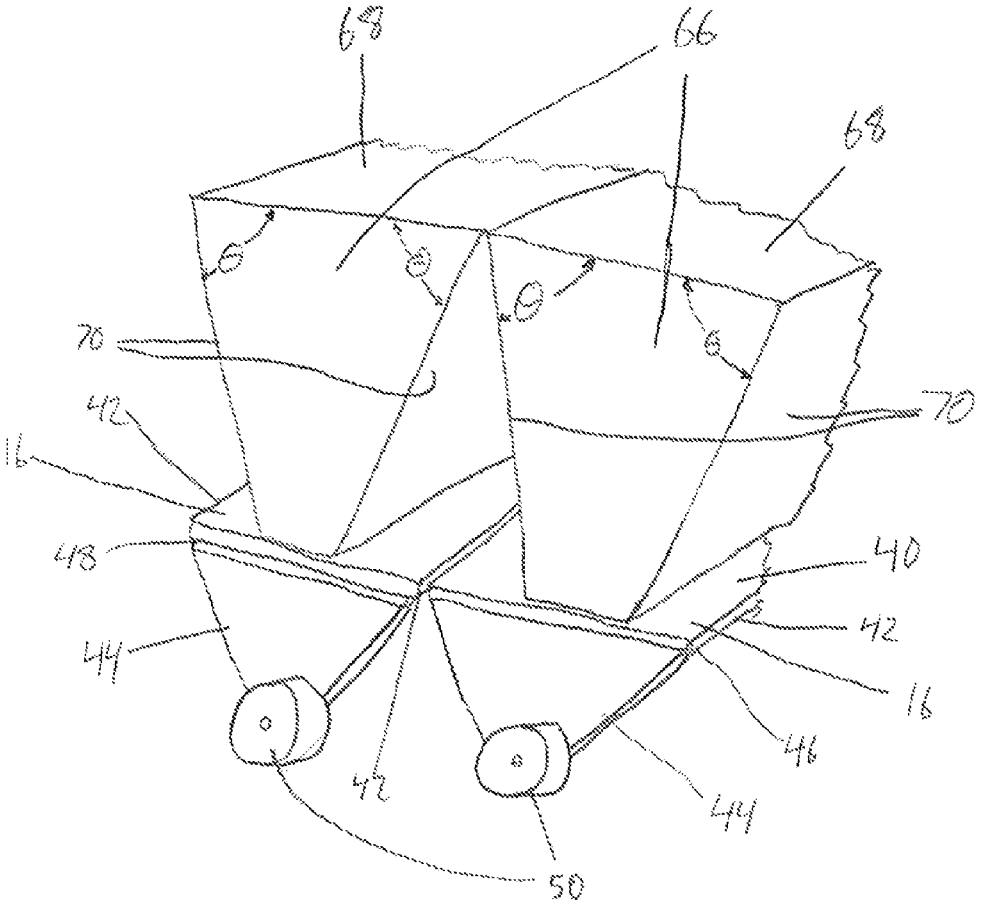
FIG. 10 is an enlarged partial view of the carriage, mounting brackets, and partitioned footrest section of the mattress pad.

As shown in greater detail in FIG. 10, each partitioned segment 66 includes an upper surface 68 and a pair of downward-extending side surfaces 70. There is an interior angle θ between the upper surface 68 and each side surface 70 that is less than 90° so that the side surfaces 70 can extend generally toward each other as the side surfaces 70 extend downward from the upper surface 68. A void is left between the side surfaces 70 of the adjacent segments 66 allowing the segments 66 to pivot downwardly over the foot-end 22 of the frame 12. The angle θ will vary depending upon a number of factors, including the thickness of the mattress pad 18 and the angle of the radius of curvature along the curvilinear portion of the track 26. Preferably, angle θ is 75° or less.

Optionally, the frame 12 can include at least a second (not shown) and a third linear actuator 72 for assisting the caregiver in positioning the patient properly. For example, the second linear actuator can be used to adjust the height of the bed 10 by driving the top 24 of the frame 12 (and carriage 14 and mattress pad 18) up or down as desired.

Figure 11:
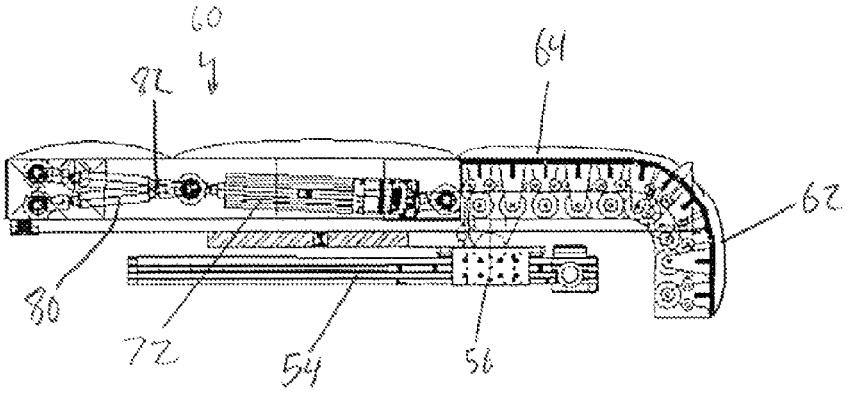
FIG. 11 is a side view of the top of the frame, mattress pad, and carriage, the frame, mattress pad, and carriage being shown partially transparent to display the linear actuators, the backrest and associated linear actuator being in a retracted position.
Figure 12:
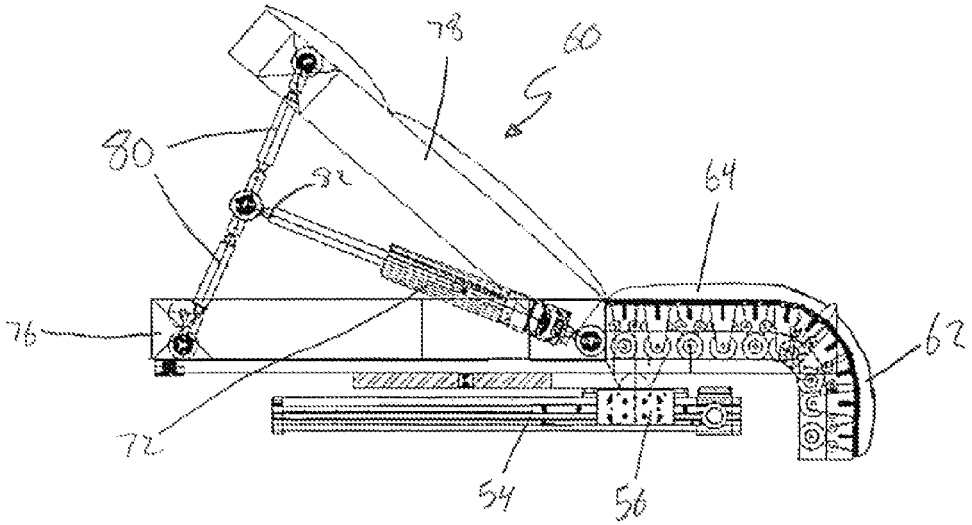
FIG. 12 is a side view of the top of the frame, mattress pad, and carriage, the frame, mattress pad, and carriage being shown partially transparent to display the linear actuators, the backrest and associated linear actuator being in an extended position.

Furthermore, and as shown in FIGS. 11 and 12, a third linear actuator 72 can be used to incline or decline the backrest section 60 of the mattress pad 18. When the third linear actuator 72 is provided, the backrest section 60 can include a frame section 76 that remains horizontal and a pivotable cushion section 78 that can pivot upwardly. There is also provided a pair of scissor extensions 80 that each extend from the end 82 of the third linear actuator 72: one scissor extension 80 connected from the end 82 of the third linear actuator 72 to the frame section 76 of the backrest section 60; and one scissor extension 80 connected from the end 82 of the third linear actuator 72 to the cushion section 78 of the backrest section 60. As the third linear actuator 72 is extended, the third linear actuator 72 drives the cushion section 78 upwardly from the frame section 76, thereby inclining the mattress pad 18 at the head-end 20 of the frame 12.

Figure 13:
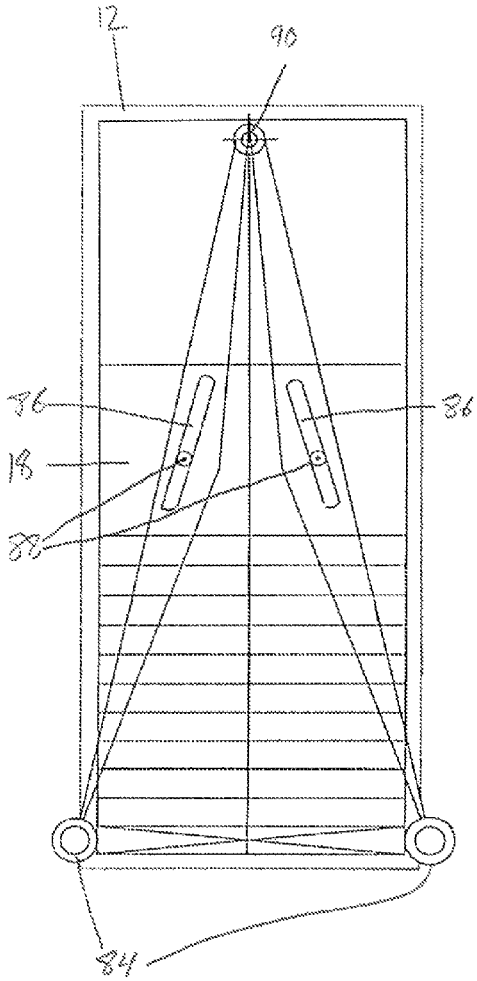
FIG. 13 is a schematic top view showing the mattress pad and leg stirrups in a retracted position.
Figure 14:
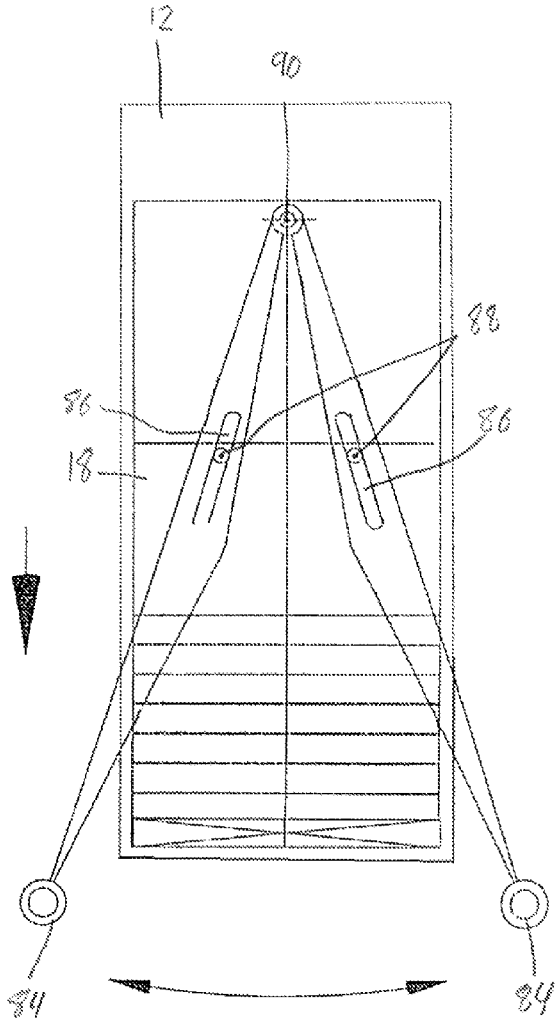
FIG. 14 is a schematic top view showing the mattress pad and leg stirrups in an extended position.

Furthermore, there is provided a pair of leg stirrups 84 for supporting the patient's legs. The leg stirrups 84 are operably connected to the mattress pad 18 and/or carriage 14 whereby the leg stirrups 84 slide outwardly from the foot-end 22 of the frame 12 and away from each other when the mattress pad 18 is translated toward the foot-end 22 of the frame 12. As shown in FIGS. 13 and 14, each leg stirrup 84 can include a slot 86 that pivots about a fixed point 88 on the frame 12. The fixed point 88 can be any suitable part of the frame 12 that does not move with respect to the frame 12 and which extends through the slot 86 in the leg stirrup 84. Preferably, each leg stirrup 84 is connected to the mattress pad 18 and/or carriage 14 at an end 90 of the leg stirrup 84 so that the translational movement thereof will also drive the leg stirrups 84 forward. The slot 86 can be straight or curved so long as the leg stirrups 84 will extend away from each other when the leg stirrups 84 are driven outwardly from the frame 12 to properly position the patient.

It is to be understood that the leg stirrups 84 can also be configured to be driven upwardly while they extend outwardly. Optionally, the leg stirrups 84 can be connected to, and driven by, a fourth linear actuator (not shown) so that the leg stirrups 84 can be operated independently of the translational mattress pad 18 movement.

According to the invention described above, a medical bed is provided which allows the caregiver to quickly and easily adjust the position of the patient. And more particularly, to adjust the position of the patient after the caregiver is already in proper position to begin the procedure or examination.

What is claimed is:

1. A medical bed comprising:

(a) a static support frame having a head-end and a foot-end;

(b) a mattress pad positioned atop the static support frame, the mattress pad having a backrest section, a medial section, and a footrest section, the backrest section oriented toward the head-end of the frame, and the footrest section oriented toward the foot-end of the frame, the mattress pad being translatable with respect to the frame, the footrest section including a plurality of partitioned segments directly attached to and substantially the same length as the footrest section, each partitioned segment includes an upper surface and a pair of downward-extending side surfaces, the interior angle θ between the upper surface and each side surface being less than 90° such that the side surfaces extend generally toward each other as the side surfaces extend downward from the upper surface, whereby a void is left between the side surfaces of the adjacent segments allowing the segments to pivot downwardly over the foot-end of the frame that are pivotable with respect to each other, and (c) wherein the footrest section cascades down and over the foot-end of the frame when the mattress pad is translated toward the foot-end.

2. The medical bed of claim 1 wherein the static support frame includes at least one linear track having a substantially straight section and a curvilinear section that curves down and over the foot-end of the medical bed, and the footrest section is slidingly connected to the track.

3. The medical bed of claim 1 including a pair of leg stirrups that are operably connected to the mattress pad whereby the leg stirrups slide outwardly from the foot-end of the frame and away from each other when the mattress pad is translated toward the foot-end.

4. The medical bed of claim 3 including a linear actuator that is operably connected to the mattress pad, wherein the linear actuator slides the mattress pad toward the foot-end of the frame when the linear actuator is activated.

5. The medical bed of claim 2 including a linear actuator that is operably connected to the mattress pad, wherein the linear actuator slides the mattress pad toward the foot-end of the frame when the linear actuator is activated.

6. The medical bed of claim 2 including a pair of leg stirrups that are operably connected to the mattress pad whereby the leg stirrups slide outwardly from the foot-end of the frame and away from each other when the mattress pad is translated toward the foot-end.

7. The medical bed of claim 6 including a linear actuator that is operably connected to the mattress pad, wherein the linear actuator slides the mattress pad toward the foot-end of the frame when the linear actuator is activated.

8. The medical bed of claim 1 including a linear actuator that is operably connected to the mattress pad, wherein the linear actuator slides the mattress pad toward the foot-end of the frame when the linear actuator is activated.

9. A medical bed comprising:

(a) a frame having a head-end and a foot-end and at least one linear track that curves down and over the foot-end of the medical bed, and the footrest section is slidingly connected to the track;

(b) a mattress pad positioned atop a frame, the mattress pad having a backrest section, a medial section, and a footrest section, the backrest section oriented toward the head-end of the frame, and the footrest section orientated toward the foot-end of the frame, the mattress pad being translatable with respect to the frame, the footrest section including a plurality of partitioned segments, each partitioned segment includes an upper surface and a pair of downward-extending side surfaces, the interior angle θ between the upper surface and each side surface being less than 90° such that the side surfaces extend generally toward each other as the side surfaces extend downward from the upper surface, whereby a void is left between the side surfaces of the adjacent segments allowing the segments to pivot downwardly over the foot-end of the frame;

(c) wherein the footrest section cascades down and over the foot-end of the frame when the mattress pad is translated toward the foot-end.

10. A medical bed comprising:

(a) a frame having a head-end and a foot-end;

(b) a pair of leg stirrups operably connected to a mattress pad, the mattress pad positioned atop the frame, the mattress pad having a backrest section, a medial section, and a footrest section, the backrest section oriented toward the head-end of the frame, and the footrest section oriented toward the foot-end of the frame, the mattress pad being translatable with respect to the frame, the footrest section including a plurality of partitioned segments that are pivotable with respect to each other, (c) each partitioned segment includes an upper surface and a pair of downward-extending side surfaces, the interior angle θ between the upper surface and each side surface being less than 90° such that the side surfaces extend generally toward each other as the side surfaces extend downward from the upper surface, whereby a void is left between the side surfaces of the adjacent segments allowing the segments to pivot downwardly over the foot-end of the frame; and (d) the pair of leg stirrups slide outwardly from the foot-end of the frame and away from each other when the mattress pad is translated toward the foot-end.

* * * * *